US006408722B1

(12) United States Patent
Chen

(10) Patent No.: US 6,408,722 B1
(45) Date of Patent: Jun. 25, 2002

(54) RATCHET WHEEL MOUNTING ARRANGEMENT FOR WRENCH

(76) Inventor: Yu-Tang Chen, No. 252, Chen Hsin Rd., Taichung (TW)

( * ) Notice: Subject to any disclaimer, the term of this patent is extended or adjusted under 35 U.S.C. 154(b) by 0 days.

(21) Appl. No.: 09/955,970

(22) Filed: Sep. 20, 2001

(51) Int. Cl.[7] ..... B25B 13/46
(52) U.S. Cl. ..... 81/60; 81/63; 81/63.2
(58) Field of Search ..... 81/60, 61, 62, 81/63, 63.1, 63.2, 58.4

(56) References Cited

U.S. PATENT DOCUMENTS 5,199,330 A * 4/1993 Arnold et al. ..... 81/63.2
6,044,731 A * 4/2000 Hsieh ..... 81/63.2
6,151,993 A * 11/2000 Shiao ..... 81/60
6,220,123 B1 * 4/2001 Chen ..... 81/63.2
6,230,591 B1 * 5/2001 Ling et al. ..... 81/63
6,301,999 B1 * 10/2001 Garg ..... 81/61
6,305,247 B1 * 10/2001 Chen ..... 81/60

* cited by examiner

*Primary Examiner*—Joseph J. Hail, III
*Assistant Examiner*—Hadi Shakeri

(57) ABSTRACT

A ratchet wheel mounting arrangement for wrench is constructed to include a wrench body with a box at one end, the box of the wrench body having a top inside annular locating groove and a bottom inside annular locating groove, a ratchet wheel mounted in the box, the ratchet wheel having an outward bottom flange engaged into the bottom inside annular locating groove of the box and a top outside locating groove, a stop block adapted to control the direction of rotation of the ratchet wheel, a cover plate put in the top inside annular locating groove of the box, the cover plate having an annular inside locating groove, and a C-shaped retainer ring fastened to the top outside locating groove of the ratchet wheel and the annular inside locating groove of the cover plate to secure them in place.

1 Claim, 5 Drawing Sheets

RATCHET WHEEL MOUNTING ARRANGEMENT FOR WRENCH

BACKGROUND AND SUMMARY OF THE INVENTION

The present invention relates to ratchet wrenches, and more specifically, to a ratchet wheel mounting arrangement for wrench, which is easy to assemble and, which stops the ratchet wheel from vibration when operated to grasp/turn the workpiece.

Regular ratchet wrenches include two types, namely, the one-way ratchet wrenches and the reversible ratchet wrenches. A ratchet wrench of either type comprises a box, a ratchet wheel mounted in the box, a spring member, and a stop member supported on the spring member and adapted to engage the ratchet wheel and to control the direction of rotation of the ratchet wheel in the box. FIG. 1 shows a one-way ratchet wrench according to the prior art. As illustrated, the ratchet wrench uses an annular cover plate to hold the ratchet wheel in the box, and a C-shaped retainer ring to secure the cover plate to the box. This ratchet wheel mounting arrangement is still not satisfactory in function. When operating the ratchet wrench to turn the workpiece, the ratchet wheel tends to be vibrated.

The present invention has been accomplished to provide a ratchet wheel mounting arrangement for wrench, which eliminates the aforesaid problem. It is one object of the present invention to provide a ratchet wheel mounting arrangement for wrench, which is easy to assemble and to disassemble. It is another object of the present invention to provide a ratchet wheel mounting arrangement for wrench, which stops the ratchet wheel from vibration when operated to grasp/turn the workpiece. To achieve these and other objects of the present invention, the ratchet wheel mounting arrangement comprises a wrench body with a box at one end, the box of the wrench body having a top inside annular locating groove and a bottom inside annular locating groove, a ratchet wheel mounted in the box, the ratchet wheel having an outward bottom flange engaged into the bottom inside annular locating groove of the box and a top outside locating groove, a stop block adapted to control the direction of rotation of the ratchet wheel, a cover plate put in the top inside annular locating groove of the box, the cover plate having an annular inside locating groove, and a C-shaped retainer ring fastened to the top outside locating groove of the ratchet wheel and the annular inside locating groove of the cover plate to secure them in place.

DETAILED DESCRIPTION OF THE PREFERRED EMBODIMENT

Figure 1:
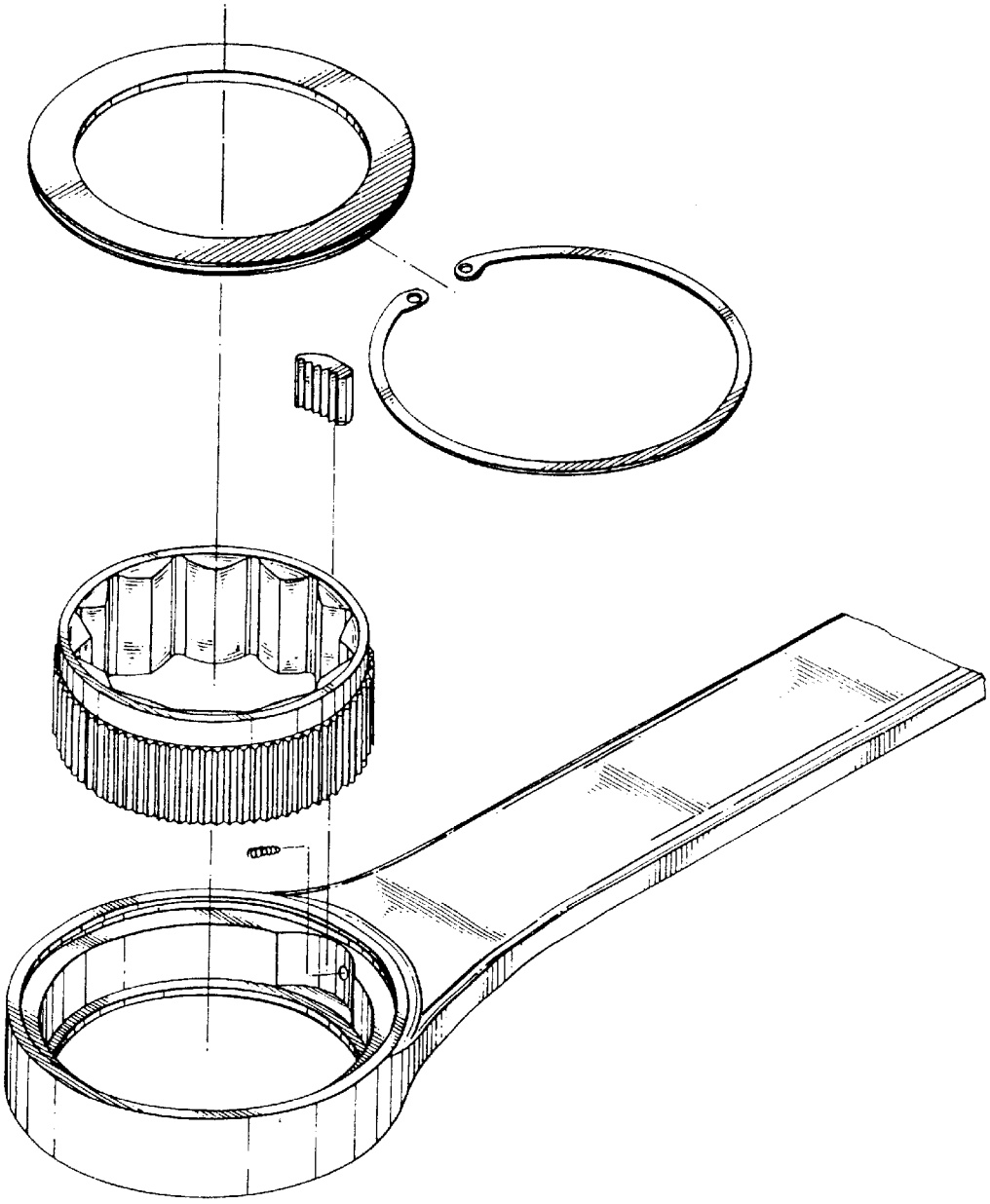
Fig . 1 PRIOR ART
FIG. 1 is an exploded view of a ratchet wheel mounting arrangement for wrench according to the prior art.
Figure 2:
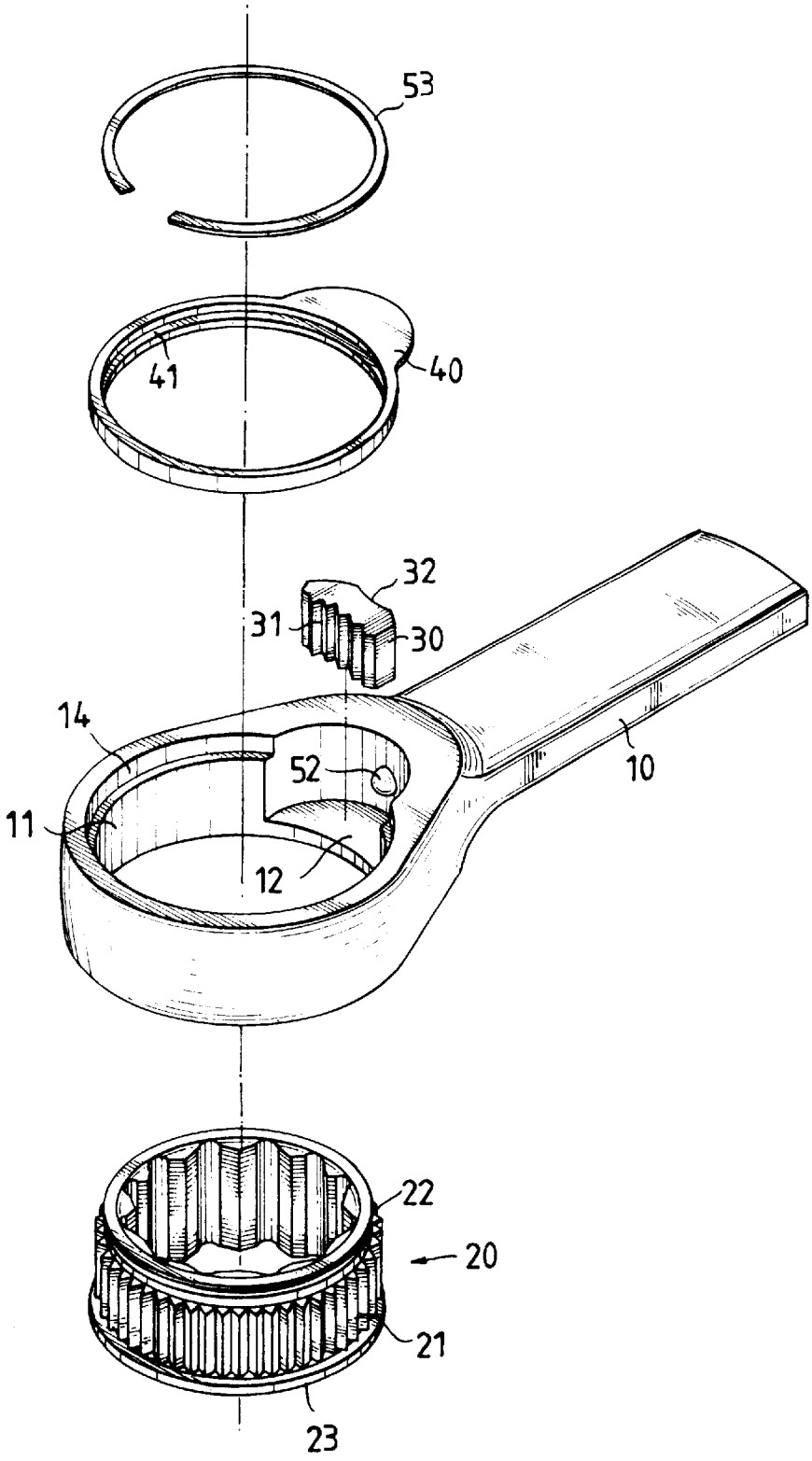
FIG. 2 is an exploded view of a ratchet wheel mounting arrangement for wrench according to the present invention.
Figure 3:
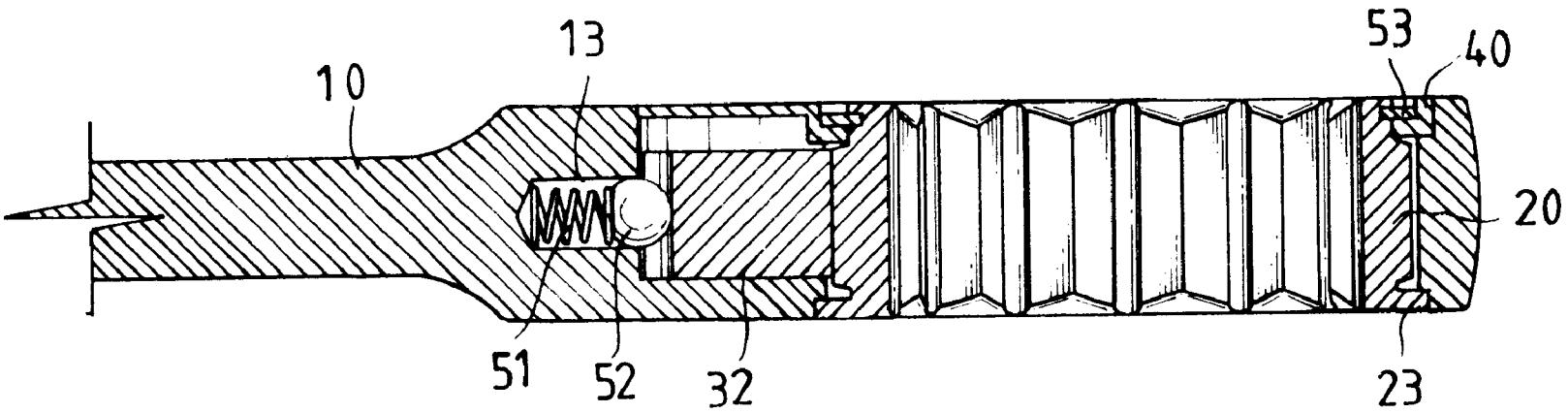
FIG. 3 is a sectional assembly view of the ratchet wheel mounting arrangement for wrench according to the present invention.

Referring to FIGS. from 2 through 3, the invention comprises a wrench body 10, a ratchet wheel 20, a stop block 30, a cover plate 40, a spring member 51, a steel ball 52, and a C-shaped retainer ring 53.

The wrench body 10 has a circular box 11 adapted to receive the ratchet wheel 20, a sector-like recess 12 disposed in the box 11 at one side and adapted to receive the stop block 30, a blind hole 13 horizontally disposed in the sector-like recess 12, which receives the spring member 51 and the steel ball 52 on the spring member 51, and two annular locating grooves 14 respectively disposed in the top and bottom sides of the circular box 11.

The ratchet wheel 20 is an internally serrated annular member comprising a series of peripheral teeth 21 arranged around the periphery and sloping in one direction for engagement with the stop block 30, an outside locating groove 22 extended around the periphery at the top side of the peripheral teeth 21, and an outward locating flange 23 protruded outwards from the periphery at the bottom side of the peripheral teeth 21.

The stop block 30 is mounted in the sector-like recess 12 inside the box 11 of the wrench body 10 and supported on the steel ball 52, having a toothed engagement face 31 disposed at the front side thereof and meshed with the sloping teeth 21 of the ratchet wheel 20 and adapted to control one-way rotation of the ratchet wheel 20 in the box 11 of the wrench body 10, and a recessed locating hole 32 disposed at the back side thereof and adapted to receive the steel ball 52.

The cover plate 40 is an annular member put into one annular locating groove 14 of the box 11 of the wrench body 10, having an annular inside locating groove 41 extended along the inner diameter thereof.

During assembly process, the spring member 51 and the steel ball 52 are respectively inserted into the blind hole 13 of the wrench body 10, and then the stop block 30 is inserted into the sector-like recess 12, keeping the steel ball 52 engaged in the recessed locating hole 32, and then the ratchet wheel 20 is inserted into the box 11 of the wrench body 10 from the bottom side to force the outward locating flange 23 into the annular locating groove 14 at the bottom side of the box 11 of the wrench body 10, and then the cover plate 40 is pushed into the annular locating groove 14 at the top side of the box 11 of the wrench body 10 to hold the stop block 30 in the sector-like recess 12, and then the C-shaped retainer ring 53 is fastened to the annular inside locating groove 41 of the cover plate 40 and the outside locating groove 22 of the ratchet wheel 20 to secure the ratchet wheel 20 and the cover plate 40 to the box 11 of the wrench body 10.

When dismounting the ratchet wheel mounting arrangement, use a lever or the like to remove the C-shaped retainer ring 53 from the cover plate 40 and the ratchet wheel 20, enabling the cover plate 40 and the ratchet wheel 20 to be respectively removed from the box 11 of the wrench body 10.

As indicated above, the mounting and dismounting procedures of the present invention are simple. Further, because the outward locating flange 23 of the ratchet wheel 20 is engaged into the annular locating groove 14 at the bottom side of the box 11 of the wrench body 10 and the outside locating groove 22 of the ratchet wheel 20 is positively secured to the cover plate 40 at the annular locating groove 14 at the top side of the box 11 of the wrench body 10 by the C-shaped retainer ring 53, the ratchet wheel 20 does not vibrate when rotated.

Figure 4:
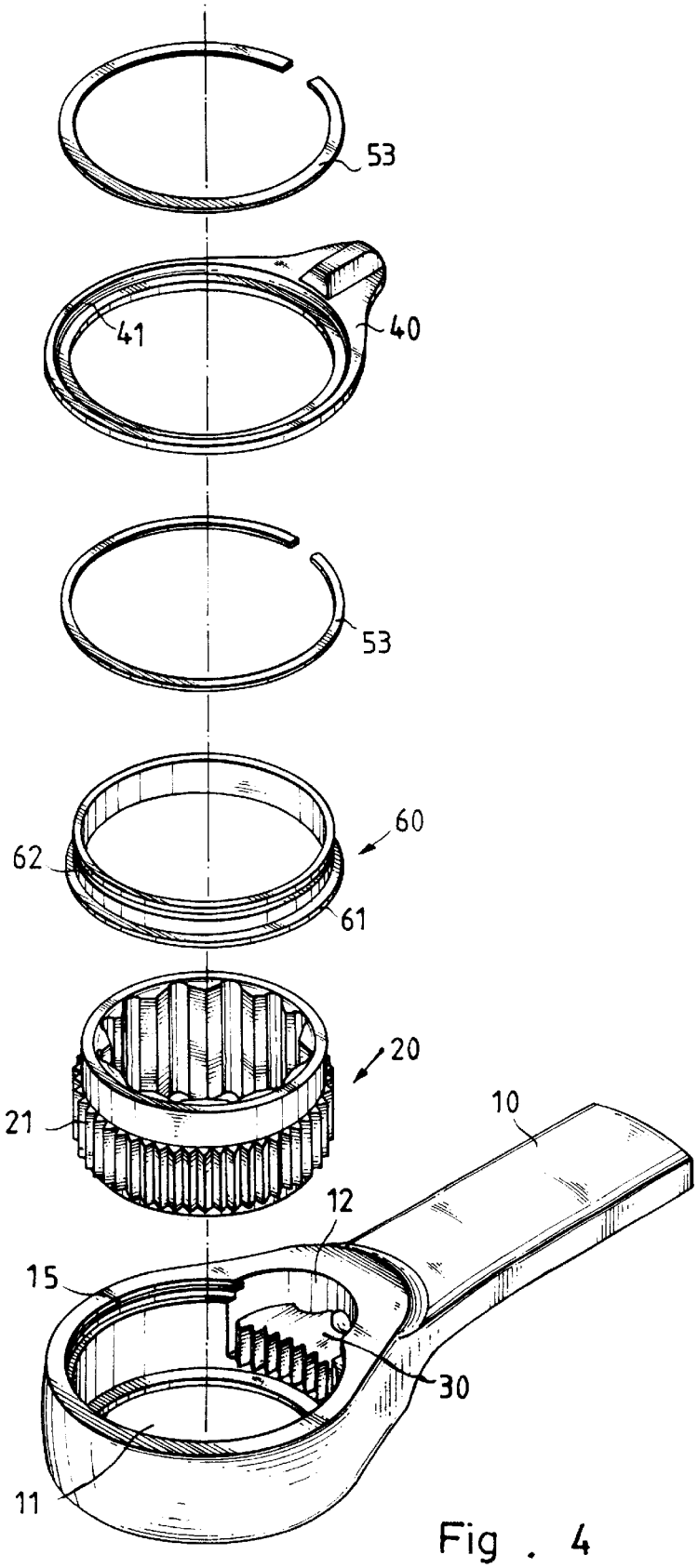
FIG. 4 is an exploded view of an alternate form of the ratchet wheel mounting arrangement for wrench according to the present invention.
Figure 5:
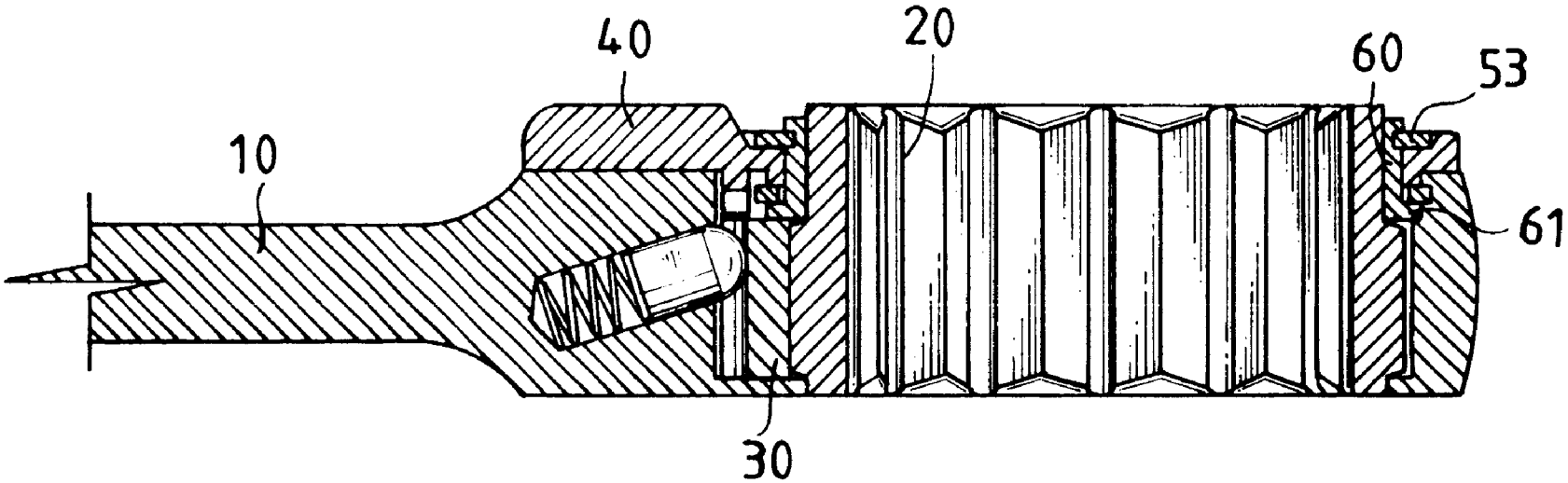
FIG. 5 is a sectional assembly of the alternate form of the present invention shown in FIG. 4.

FIGS. 4 and 5 show an alternate form of the present invention. This alternate form is used in a reversible ratchet wrench. As illustrated, the box 11 of the wrench body 10 has an inside annular locating groove 15 at the top side; a hoop 60 is sleeved onto the periphery of the ratchet wheel 20 and stopped above the peripheral teeth 21, the hoop 60 having an outward bottom flange 61 protruded from the periphery at the bottom side, and an outside annular groove 62 extended along the periphery at the top side; two C-shaped retainer rings 53 are respectively mounted in the inside annular locating groove 15 of the box 11 of the wrench body 10 and the annular inside locating groove 41 of the cover plate 40 and forced into engagement with the outward bottom flange 61 and outside annular groove 62 of the hoop 60 to secure the hoop 60 and the ratchet wheel 20 in the box 11 of the wrench body 10.

A prototype of ratchet wheel mounting arrangement for wrench has been constructed with the features of FIGS. 2~5. The ratchet wheel mounting arrangement for wrench functions smoothly to provide all of the features discussed earlier.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A ratchet wheel mounting arrangement comprising a wrench body, said wrench body comprising a box at one end thereof, an annular locating groove disposed in said box at a top side, a sector-like recess disposed in said box at one side, and a horizontal blind hole disposed in said sector-like recess;

an internally serrated annular ratchet wheel mounted in said box of said wrench body, said ratchet wheel comprising a series of sloping teeth arranged around a periphery thereof and sloping in one direction;

a stop block mounted in said sector-like recess of said wrench body and adapted to control a direction of rotation of said ratchet wheel in said box, said stop block having a toothed engagement face disposed at a front side thereof and engaged with the sloping teeth of said ratchet wheel and a recessed locating hole disposed at a back side thereof;

a spring-supported positioning means mounted in said blind hole of said wrench body and engaged into the recessed locating hole of said stop block to support said stop block in engagement whit the sloping teeth of said ratchet wheel;

a cover plate covered on said box of said wrench body to hold said ratchet wheel and said stop block inside said box and said sector-like recess of said wrench body; and a fastening structure fastened to said box of said wrench body to secure said cover plate and said ratchet wheel to said box of said wrench body;

wherein said cover plate has an annular inside locating groove extended along an in side wall thereof; said fastening structure comprises a hoop sleeved onto the periphery of said ratchet wheel and stopped above said sloping teeth of said ratchet wheel, said hoop comprising an outward bottom flange protruded from a periphery thereof at a bottom side and an outside annular groove extended along the periphery thereof at a top side, a first C-shaped retainer ring mounted in the annular locating groove of said box of said wrench body and forced into engagement with the outward bottom flange of said hoop, and a second C-shaped retainer ring mounted in the annular locating groove of said box of said wrench body and the annular inside locating groove of said cover plate and forced into engagement with the outside annular groove of said hoop.

* * * * *